US006350532B1

(12) United States Patent
Davisson et al.

(10) Patent No.: US 6,350,532 B1
(45) Date of Patent: Feb. 26, 2002

(54) ALUMINUM ALLOY COMPOSITION AND METHOD OF MANUFACTURE

(75) Inventors: Thomas L. Davisson, Chardon, OH (US); Luc Montgrain; Daniel Pulliam, both of Terre Haute, IN (US); Sadashiv Nadkarni, Lexington, MA (US)

(73) Assignee: Alcan International Ltd., Montreal (CA)

( * ) Notice: Subject to any disclaimer, the term of this patent is extended or adjusted under 35 U.S.C. 154(b) by 0 days.

(21) Appl. No.: 09/381,882

(22) PCT Filed: Mar. 18, 1998

(86) PCT No.: PCT/CA98/00238

§ 371 Date: Jan. 18, 2000

§ 102(e) Date: Jan. 18, 2000

(87) PCT Pub. No.: WO98/45492

PCT Pub. Date: Oct. 15, 1998

Related U.S. Application Data

(60) Provisional application No. 60/042,638, filed on Apr. 4, 1997.

(51) Int. Cl.[7] ..... B21C 37/00; C22F 1/04; C22C 21/12

(52) U.S. Cl. ..... 428/606; 148/551; 148/552; 148/696; 148/416; 148/438; 420/529; 420/537; 420/538; 420/548; 420/550; 420/553

(58) Field of Search ..... 428/606; 420/529, 420/537, 538, 548, 550, 553; 148/551, 552, 696, 416, 438

(56) References Cited

U.S. PATENT DOCUMENTS 3,818,566 A * 6/1974 Anderson et al. ..... 420/537
4,163,665 A * 8/1979 Pearson ..... 148/438
5,618,358 A * 4/1997 Davisson et al. ..... 148/551

FOREIGN PATENT DOCUMENTS

| | | | |
|---|---|---|---|
| GB | 1479429 | 7/1977 | |
| JP | 02011735 | 1/1990 | |
| JP | 05-320798 | 5/1992 | |
| JP | 05-320798 A | * 12/1993 | ..... C22C/21/00 |
| JP | 05320798 | 12/1993 | |
| JP | 02-011735 | 6/1998 | |
| WO | WO 95/25825 | 9/1995 | |

OTHER PUBLICATIONS

Davies, J.R., "Aluminum and Aluminum Alloys," 1993 ASM International, USA XP002068409 see p. 33–p. 36 (No Month Given).

* cited by examiner

*Primary Examiner*—Robert R. Koehler
(74) *Attorney, Agent, or Firm*—Robert D. Katz; Cooper & Dunham LLP

(57) ABSTRACT

The invention relates to a recyclable aluminum foil. The foil is made of an alloy containing 0.2%–0.5% Si, 0.4%–0.8% Fe, 0.1%–0.3% Cu, and 0.05%–0.3% Mn by weight. with the balance aluminum and incidental impurities. The foil contains at least about 2% by weight of strengthening particulates and has at least about 0.1% by weight of the copper and/or manganese retained in solid solution. The invention also relates to a method of manufacturing a sheet of aluminum based on an alloy which involves continuously casting an alloy of the above composition to form a sheet of alloy, coiling said sheet of alloy, cold rolling the sheet of alloy, interannealing the alloy after a first pass of the cold rolling; and further cold rolling the alloy to a final desired gauge. The foil, which is suitable for household use, has improved strength due to a larger quantity of dispersoids fortified by elements in solid solution, and can be recycled with other alloy scrap.

16 Claims, No Drawings

ALUMINUM ALLOY COMPOSITION AND METHOD OF MANUFACTURE

CROSS-REFERENCE TO RELATED APPLICATION

This application claims the priority right of prior Provisional Patent Application Serial No. 60/042,638, filed Apr. 4, 1997.

TECHNICAL FIELD

This invention relates to aluminum alloy sheet products and methods for making them. Specifically, this invention relates to a new aluminum alloy for household foil.

BACKGROUND ART

Household aluminum foils are often produced from alloys that are cast as ingots by a process commonly referred to as direct chill or DC casting. The ingots are generally hot rolled and then cold rolled. Multiple passes through the hot rolling mill and the cold rolling mill are required to produce a foil. Often, after the first pass through the cold rolling mill, the alloy is subject to an interanneal. Then the alloy is rolled to its final desired gauge and optionally annealed again to produce a household foil. A common final gauge of household foil is 0.00155 cm (0.00061 inches) although foil is generally considered to be any sheet less than about 0.0254 cm (0.01 inches).

An interanneal is usually performed after the first and/or the second cold rolling pass. The interannealing process is carried out in order to ensure easy rollability to the final, desired gauge. Without this interanneal, the sheet may incur an excessive amount of work hardening and make further rolling difficult, if not impossible.

Compositions of some alloys currently used to produce household aluminum foil from DC cast ingots, and selected properties of these alloys in the fully annealed state at a foil gauge of 0.00155 cm (0.00061 inches) are given below in Table 1 below.

TABLE 1

| | Nominal Composition and Selected Properties of Annealed Foils | | | | | | |
|---|---|---|---|---|---|---|---|
| Alloy | Si | Fe | Cu | Mn | UTS[1] (ksi) | YS[2] (ksi) | Mullen |
| 1100 | 0.06 | 0.45 | 0.12 | — | 10.7 | 5.9 | 14.1 |
| 1200 | 0.17 | 0.65 | — | — | 10.1 | 6.1 | 8.6 |
| 8111 | 0.57 | 0.57 | — | — | 10.7 | 6.8 | 12.7 |
| 8015 | 0.12 | 0.95 | — | 0.2 | 18 | 15 | 15 |
| 8006 | 0.22 | 1.58 | — | 0.43 | 18.5 | 13.4 | |

[1]Ultimate Tensile Strength
[2]Yield Strength

Alloys commonly used for producing household aluminum foils include 1100 and 1200 type alloys. As evidenced by Table 1, these commonly used foil alloys tend to be weaker than alloys such as 8015 or 8006. While alloys 8015 or 8006 tend to have greater strength than the standard foil alloys, the high iron content in alloys 8015 and 8006 results in foils that are unsuitable for re-melting with aluminum beverage can scrap. Thus, the economical consideration of re-melting forces use of the lower strength/less resilient 1100 or 1200 alloys to produce household aluminum foil.

Alloys 8015 and 8006 yield a stronger foil because their properties do not deteriorate as rapidly as 1100 or 1200 alloys after annealing. Deterioration is slowed or stopped by the dispersoids produced in 8015 and 8006 alloys during the interanneal, and also by the manganese and copper that remain in solid solution. Alloys such as 1100 and 1200 can be easily work hardened to produce a relatively strong foil after cold rolling. Once these alloys are annealed, however, their yields strength decreases rapidly.

The principal reason for this rapid decrease in yield strength is that 1100 and 1200 alloys have little or no solution strengthening elements, such as copper or manganese, remaining in solution. Also, these alloys have very few dispersoids. For example, 1100 alloy typically has a particulate content of about 0.8%, while 1200 alloy has a 1.6% content, and 8111 has a 1.8% content.

In contrast, alloy 8006 typically has a particulate content of 3.5% and alloy 8015 has a content of 2.6%. Furthermore, 8015 alloy when produced on a continuous caster retains almost all of its manganese in solid solution to provide considerable solution strengthening. Thus, due to the large quantities of dispersoids fortified by elements in solid solution, these alloys are able to retain their strength to a much greater extent after annealing.

Another important aspect when considering aluminum alloys for producing household foils is the castability of that alloy. Typically, alloys with a wider freezing range and higher silicon content are easier to cast than alloys with narrow freezing ranges and low silicon content. For example, alloy 8015 has a narrow freezing range and is difficult to cast on a continuous caster. Finally, to prevent the formation of a dull surface due to magnesium oxidation, the amount of magnesium needs to be strictly limited.

DISCLOSURE OF THE INVENTION

An object of the present invention is to provide an improved alloy suitable for the production of aluminum foil and a method for manufacture of the alloy.

According to one aspect of the invention there is provided a recyclable aluminum foil having a thickness of less than 0.0254 cm (0.01 inches) characterized in that said foil results from a continuous strip casting process and is made of an alloy containing 0.2%–0.5% Si, 0.4%–0.8% Fe, 0.1%–0.3% Cu, and 0.05%–0.3%Mn by weight, with the balance aluminum and incidental impurities, said foil containing at least 2% by weight of strengthening particulates and having at least 0.1% by weight of said copper and/or manganese retained in solid solution.

According to another aspect of the invention there is provided an alloy sheet having a thickness of less than 0.0254 cm (0.01 inches), characterized in that said sheet results from a continuous strip casting process and contains 0.2% –0.5%–Si, 0.4%–0.8%–Fe, 0.1%–0.3% Cu, and 0.1%–0.3% Mn by weight, with the balance aluminum and incidental impurities, having a yield strength of at least 10 ksi in the fully annealed condition.

According to yet another aspect of the invention there is provided a method of manufacturing a sheet of aluminum-based alloy, in which a sheet of alloy is cast by continuous strip casting to form a cast sheet less than 5 cm (2 inches) thick, the cast sheet is coiled, the coiled sheet is cold rolled to final gauge by a procedure involving several passes, the sheet being interannealed at a temperature in the range of 250 to 450° C. after a first pass and rolled to final gauge in one or more subsequent passes, characterized in that said alloy contains, by weight, at least 0.2% and up to 0.5% silicon, at least 0.4% and up to 0.8% iron, at least 0.1% and up to 0.3% copper, at least 0.1% and up to 0.3% manganese, and the balance aluminum and incidental impurities.

An important aspect of the present invention is thus a new aluminum alloy composition suitable for use as household foil having improved strength due to a larger quantity of dispersoids fortified by elements in solid solution. The invention also provides an economical method for the manufacture of a household aluminum foil made of this alloy using a continuous caster.

The alloy of the invention, unlike alloys typically used for the production of foil, can be continuously cast with an interanneal to yield foil with the formability and drawability of the 1100 and 1200 alloys while retaining the high strength characteristics of the 8015 and 8006 alloys. This is accomplished through a balanced strengthening mechanism in which the ratio of iron to silicon is adjusted such that at least about 2% of strengthening particulates are formed in the foil and at least 0.1% by weight of copper and/or manganese are retained in sold solution.

In summary, the present invention teaches a new aluminum based alloy composition for use as a household aluminum foil and a low cost method of manufacturing the foil. The present application retains the continuous casting and process properties of conventional alloys used for household foils, while exhibiting the strength properties of alloys having a higher iron content that are consequently less desirable in the recycling stream.

BEST MODES FOR CARRYING OUT THE INVENTION

The present invention provides a new aluminum alloy for use in household foil and a method of manufacture of such foil. The composition as described in this invention yields all of the desirable properties required for a household aluminum foil. The alloy is suitable for casting on a continuous caster followed by cold rolling of the alloy with an interanneal after a first pass of cold rolling. After being rolled to a final gauge, the resulting foil is stronger than the current household foils while retaining desirable recyclability attributes.

Broadly stated, the composition of the alloy of the present invention contains:

at least 0.2% and up to 0.5% by weight silicon, at least 0.4% and up to 0.8% by weight iron, at least 0.1% and up to 0.3% by weight copper, at least 0.05% and up to 0.3% by weight manganese, no more than 0.01% by weight magnesium, and the balance aluminum and incidental impurities.

The present alloy contains silicon at least about 0.2% and up to about 0.5% by weight silicon and preferably between 0.25% and 0.4%. Alloys with a wider freezing range and higher silicon content are easier to cast than those with narrower freezing ranges and lower silicon content. However, further increase of the silicon content can result in precipitation of silicon in the alloy which can increase wear during subsequent working and forming operations. Thus, to allow the alloy to be continuously cast in a conventional manner, the silicon content should be maintained in the aforementioned range.

The present alloy contains iron in an amount of at least about 0.4% and up to about 0.8% by weight and preferably between 0.5% and 0.7%. The iron aids in giving the alloy higher strength characteristics such as those found in the 8015 and 8006 alloys, but the increase in strength must be balanced with the effect that iron levels can have on recycling. High iron alloys, such as 8006 and 8015, are not as valuable in recycling because they cannot be recycled into the low iron alloys without blending in primary low iron metal to reduce the overall iron level. Recyclable beverage can sheet requires lower levels of iron than the levels found in 8015 and 8006 alloys. Beverage can sheet is currently one of the most valuable uses for recycled aluminum alloys and it requires a low iron content.

The ratio of Fe/Si is desirably adjusted so that substantially all of the iron and silicon precipitate to form dispersoids.

The present alloy contains copper in an amount of at least about 0.1% and up to about 0.3% by weight and preferably between 0.15% and 0.25%. When remaining in solution, copper acts as a solution strengthening element. The copper contributes to the strength of the alloy and must be present in an amount adequate to provide desired levels of strengthening. Also, copper is able to retain its strengthening characteristics to a great extent after annealing. By remaining in solution after annealing, it is believed that large quantities of dispersoids can by fortified by the copper remaining in solid solution. However, while copper increases the strength of the present alloy, amount excessive to the aforementioned ranges can lead to formation of precipitates that accelerate corrosion. Accordingly, it is preferable to maintain the copper level at no more than 0.25% by weight.

The present alloy contains at least about 0.05% and up to about 0.3% manganese by weight. Advantageously, the manganese level is at least about 0.1% and, preferably, the manganese level is between 0.15% and 0.25%. As with the copper content, the manganese should be present in an amount so that it remains in solution after annealing. The manganese is believed to fortify the dispersoids of the alloy by remaining in solution. Also, manganese retards the decrease in yield strength that occurs during annealing as exhibited by the 1100 and 1200 alloys. However, the manganese content should remain at the specified levels because higher amounts of manganese results in difficulty when cold rolling. Therefore, the manganese content should be controlled as a level at which strength remains high after annealing, but the rollability of the alloy is not significantly affected.

The magnesium level of the present alloy should be maintained at no greater than 0.01%. The magnesium level should not exceed 0.01% as higher levels lead to magnesium oxidation which results in a dull surface finish. After the alloy is melted and the composition adjusted within the above described limits, the present alloy may be cast on a continuous casting machine adapted for making sheet products. Several continuous casting processes and machines have been developed or are in commercial use today for casting aluminum alloys specifically for rolling into sheet. These include the twin belt caster, twin roll caster, block caster, single roll caster and others. These casters are generally capable of casting a continuous sheet of aluminum alloy less than 5 cm (2 inches) thick and as wide as the design width of the caster. optionally, the continuously cast alloy can be rolled to a thinner gauge immediately after casting in a continuous hot rolling process. This form of casting produces an endless sheet of relatively wide, relatively thin alloy. After continuous casting, the aluminum is coiled and cooled to room temperature. Typically, the continuously cast sheet will have a thickness of less than about 2.54 cm (1.0 inch) and, if rolled immediately after casting, may have a thickness of about 0.127 to 0.254 cm (0.05 to 0.1 inches) when coiled.

Cold rolling is then conducted in multiple passes with an interanneal provided after the first or second pass while the sheet is at an intermediate gauge. The interanneal is performed so that the foil can be rolled to a final, desired gauge more easily. The interanneal can be performed at between about 250° C. or 450° C. for a period of about 5 minutes to about 6 hours. Without the interanneal, the alloy may incur an undesirable amount of work hardening which in turn makes further rolling of the alloy into foil difficult. Cold rolling is then continued to reduce the thickness of alloy from the intermediate gauge sheet with a thickness of about 0.05 to about 1.0 cm (0.02 to about 0.4 inches) to a final desired gauge.

The present alloy produced in this fashion achieves a dispersoid content of at least 1% and advantageously 2% or higher, and preferably 2.5% or more. Furthermore, the decrease of yield strength during annealing is retarded by the manganese and copper. Thus, a new alloy having a yield strength similar to 8006 and 8015 alloys in combination with the desirable cold rolling and recyclability properties found in the conventional aluminum foil alloys 1100 and 1200 can be formed.

The complex strengthening mechanism achieved in the aluminum foil product of this invention is the result of striking a unique balance between two often competing strengthening mechanisms; i.e., solid solution strengthening and dispersoids (or particulate) strengthening. It is well know that during the heating and rolling of aluminum, elements and compounds in the aluminum alloy are dynamically dissolving and precipitating, continually changing the chemical and physical properties of the alloy. Elements such as copper and manganese increase the strength of the alloy when they are in solid solution, and dispersoids (particulates) such as $Al_3Fe$, $Al_{12}Fe_3Si$, $Al_9Fe_2Si_2$, $Al_6Mn$, $Al_{15}Fe_3Si_2$, $Al_{12}Mn_3Si_2$ and others impart strength when they form particles of less than two micron dispersoids in the aluminum alloy.

The balance struck between these two strengthening mechanisms in the present invention produces an aluminum foil product having good strength that is economical to produce and highly valued in the recycling stream. This is a combination of properties that has not previously been achieved.

EXAMPLES

An alloy of the present invention was cast with the composition, by weight, of:

0.32% silicon, 0.65% iron, 0.20% copper, 0.25% manganese, with the balance aluminum and incidental impurities.

This alloy was cast using a belt caster and immediately rolled while still hot to a thickness of 0.14478 cm (0.057 inches) to produce a coil. It was further cold rolled to a thickness of 0.056 cm (0.022 inches) and interannealed for 2 hours at 275° C. After the interanneal, the alloy was rolled to a final thickness of 0.00155 cm (0.00061 inches) and annealed at 330° C. for two hours. The properties of this Example can be seen in Table 2 below.

Another sample was cast and rolled to final gauge using a procedure to that used for Sample 1 except the interanneal was conducted at 425° C. and the sample had a composition by weight of 0.32% silicon, 0.55% iron, 0.14% copper and 0.07% manganese. The properties of this Sample 2 can also be seen in Table 2 below.

A third Sample was prepared with the composition by weight of 0.06% silicon, 0.65% iron, 0.18% copper and 0.15% manganese. This third Sample was cast and rolled to final gauge by the procedure described above for Example 2 except that Sample 3 was interannealed at 275° C. The properties of Sample 3 can be seen in Table 2 below.

Finally, a fourth Sample was interannealed at 425° C. Sample 4 had the same composition by weight as Sample 3 but was produced with a different interanneal temperature.

TABLE 2

Properties of Example Alloys

| Sample | UTS (ksi) | YS | Mullen | Elong (%) |
|---|---|---|---|---|
| 1 | 20.53 | 17.98 | 16.5 | 1.2 |
| 2 | 11.0 | 5.74 | 13.3 | 3.2 |
| 3 | 12.7 | 8.3 | 9.8 | 3.5 |
| 4 | 11.7 | 5.7 | 14.0 | 3.5 |

The yield strength (YS) and elongation (Elong %) were determined according to ASTM test method E8.

As can be seen in Table 2, the properties of Sample 1 are very similar to those of 8015. Also, Sample 1 had a particulate content of about 2.8%. However, Sample 1 avoids the extremely high iron content of 8015 that results in recycling difficulties.

Samples 2, 3 and 4 had either a lower manganese and copper content and thus have a lower concentration of solid solution and/or a lower particulate content than Sample 1. Also, these Samples 2 and 4 were intereannealed at a higher temperature used when the foil was formulated. The high interanneal temperature coupled with the aforementioned low concentration of elements in solid solution and low particulate content lead to these examples having inferior properties compared to alloy 8015.

In summary, the present invention teaches a new aluminum based alloy composition for use as a household aluminum foil that has enhanced strength properties. Sample 1 evidences a yield strength and ultimate tensile strength that is comparable to that of alloys 8015 and 8006. While having strength properties comparable to these high iron content alloys, the present alloy retains the formability and desired recyclability of the 1100 and 1200 alloys with lower amounts of iron than those found in 8015 and 8006 alloys. The present alloy exhibits the properties of 8015 and 8006 alloys while retaining ease of recycling. Also, the present invention teaches a cost efficient of manufacturing the alloy into household aluminum foil.

What is claimed is:

1. A recyclable aluminum foil having a thickness of less than 0.0254 cm (0.01 inches) characterized in that said foil results from a continuous strip casting process and is made of an alloy containing 0.2%–0.5% Si, 0.4%–0.8% Fe, 0.1%–0.3% Cu, and 0.05%–0.3% Mn by weight, with the balance aluminum and incidental impurities, said foil containing at least 2% by weight of strengthening particulates and having at least 0.1% by weight of said copper and/or manganese retained in solid solution.

2. A foil according to claim 1, characterized in that said foil contains at least 0.1% manganese.

3. A foil according to claim 1, characterized in that said foil contains no more than 0.25% copper.

4. A foil according to claim 1, claim 2 or claim 3, characterized in that said foil contains at least 0.25% and less than 0.4% silicon.

5. A foil according to claim 1, claim 2, or claim 3, characterized in that said foil contains at least 0.5% and less than 0.7% iron.

6. An alloy sheet having a thickness of less than 0.0254 cm (0.01 inches), characterized in that said sheet results from a continuous strip casting process and contains 0.2%–0.5% Si, 0.4%–0.8% Fe, 0.1%–0.3% Cu, and 0.1%–0.3% Mn by weight, with the balance aluminum and incidental impurities, having a yield strength of at least 10 ksi in the fully annealed condition.

7. An alloy sheet according to claim 6, characterized in that said alloy contains at least 0.25% and less than 0.4% silicon.

8. An alloy sheet according to claim 6 or claim 7, characterized in that said alloy contains at least 0.5% and less than 0.7% iron.

9. A method of manufacturing a sheet of aluminum-based alloy, in which a sheet of alloy is cast by continuous strip casting to form a cast sheet less than 5 cm (2 inches) thick, the cast sheet is coiled, the coiled sheet is cold rolled to final gauge by a procedure involving several passes, the sheet being interannealed at a temperature in the range of 250 to 450° C. after a first pass and rolled to final gauge in one or more subsequent passes, characterized in that said alloy contains, by weight, at least 0.2% and up to 0.5% silicon, at least 0.4% and up to 0.8% iron, at least 0.1% and up to 0.3% copper, at least 0.1% and up to 0.3% manganese, and the balance aluminum and incidental impurities.

10. A method according to claim 9, characterized in that the alloy has a particulate content of at least 2.0%.

11. A method according to claim 9, characterized in that said final gauge is less than 0.0254 cm (0.010 inches) thick.

12. A method according to claim 9, 10 or 11, characterized in that said alloy contains at least 0.1% by weight of said copper and/or manganese retained in solid solution.

13. A method according to claim 9, 10 or 11, characterized in that said alloy contains at least 0. 15% and less than 0.3% manganese.

14. A method according to claim 9, 10 or 11, characterized in that said alloy contains no more than 0.25% copper.

15. A method according to claim 9, 10 or 11, wherein said alloy contains at least 0.25% and less than 0.4% silicon.

16. A foil according to claim 4, wherein the foil contains at least 0.5% and less than 0.7% iron.

* * * * *

UNITED STATES PATENT AND TRADEMARK OFFICE

CERTIFICATE OF CORRECTION

PATENT NO. : 6,350,532 B1
DATED : February 26, 2002
INVENTOR(S) : Davisson et al.

It is certified that error appears in the above-identified patent and that said Letters Patent is hereby corrected as shown below:

Title page,
Item [60], should read -- Provisional application No. 60/042,689, filed on April 4, 1997. --

Signed and Sealed this

Third Day of June, 2003

JAMES E. ROGAN
*Director of the United States Patent and Trademark Office*